US007052352B2

(12) United States Patent
Rasmussen

(10) Patent No.: US 7,052,352 B2
(45) Date of Patent: May 30, 2006

(54) ANODE SCREEN FOR A PHOSPHOR DISPLAY AND METHOD OF MAKING THE SAME

(75) Inventor: Robert T. Rasmussen, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 156 days.

(21) Appl. No.: 10/441,716

(22) Filed: May 20, 2003

(65) Prior Publication Data

US 2003/0201710 A1 Oct. 30, 2003

Related U.S. Application Data

(62) Division of application No. 09/436,967, filed on Nov. 9, 1999, now Pat. No. 6,570,322.

(51) Int. Cl.
*H01J 9/00* (2006.01)

(52) U.S. Cl. ..... 445/24; 445/23

(58) Field of Classification Search ..... 313/495–497, 313/467, 473, 503–506, 582; 445/23, 24, 445/5, 52; 430/26
See application file for complete search history.

(56) References Cited

U.S. PATENT DOCUMENTS

| | | | | |
|---|---|---|---|---|
| 4,325,002 A | | 4/1982 | Kobale et al. | 313/485 |
| 4,891,110 A | * | 1/1990 | Libman et al. | 204/478 |
| 5,063,327 A | | 11/1991 | Brodie et al. | 313/482 |
| 5,128,063 A | | 7/1992 | Kamikubo | 252/301.5 |
| 5,314,759 A | | 5/1994 | Harkonen et al. | 428/690 |
| 5,411,759 A | * | 5/1995 | Kawashima et al. | 427/58 |
| 5,498,925 A | | 3/1996 | Bell et al. | 313/497 |
| 5,561,345 A | | 10/1996 | Kuo | 313/495 |

(Continued)

OTHER PUBLICATIONS

Cathey, Jr., "Field Emission Displays", *International Symposium on VLSI Technology Systems and Applications, Proceedings of Technical Papers*, May 31–Jun. 2, 1995, Taipei, Taiwan, 1995; pp. 131–136.

U.S. patent application entitled "Electroluminescent Material and Method of Making Same", Filed Mar. 23, 1998, Ser. No. 09/046,069, 6004686.

U.S. patent application entitled "Methods of Forming a Face Plate Assembly of a Color Display", Filed Jun. 11, 1998, Ser. No. 09/096,365, 6319381.

U.S. patent application entitled "Field Emission Device with Buffer Layer and Method of Making", Filed Jun. 11, 1998, Ser. No. 09/096,085, 6211608.

*Primary Examiner*—Vip Patel
*Assistant Examiner*—Glenn Zimmerman
(74) *Attorney, Agent, or Firm*—Wong, Cabello, Lutsch, Rutherford & Brucculeri, LLP

(57) ABSTRACT

An anode screen for a field-emission-display is formed by layering light-permeable conductive material and phosphor respectively over a transparent substrate. A plurality of holes are formed in the layer of phosphor to expose corresponding regions of the conductive material. In a further embodiment, the anode screen is disposed in spaced and opposing relationship to a cathode emitter plate that comprises a plurality of electron emitters. Pixel regions of the phosphor of the anode screen correspond to regions of the phosphor opposite respective electron emitters of the plurality of electron emitters. Preferably, each pixel region of the phosphor has a number of holes spaced equally about its periphery. In the preferred embodiment, six holes delimit a hexagon shape for their respective pixel region, wherein centers of the holes provide apexes of the hexagon.

106 Claims, 9 Drawing Sheets

U.S. PATENT DOCUMENTS 5,593,562 A * 1/1997 Vickers ..... 204/486
5,601,751 A 2/1997 Watkins et al. ..... 252/301.4 R
5,663,742 A 9/1997 Hush ..... 345/75.2
5,670,296 A 9/1997 Tsai ..... 430/312
5,703,611 A 12/1997 Kishino et al. ..... 345/75.2
5,720,640 A * 2/1998 Lu et al. ..... 445/24
5,721,561 A 2/1998 Kishino et al. ..... 345/75.2
5,762,773 A 6/1998 Rasmussen ..... 204/485
5,783,910 A 7/1998 Casper et al. ..... 315/167
5,798,604 A 8/1998 Duboc, Jr. et al. ..... 313/495
5,808,400 A 9/1998 Liu ..... 313/306
5,814,934 A 9/1998 Tsai ..... 313/495
5,821,685 A * 10/1998 Peterson ..... 313/467
5,830,527 A 11/1998 Vickers ..... 216/11
5,844,361 A 12/1998 Petersen ..... 313/495
5,866,979 A 2/1999 Cathey, Jr. et al. ..... 313/496
5,869,928 A 2/1999 Liu et al. ..... 313/495
5,871,383 A 2/1999 Levine et al. ..... 445/52
6,140,766 A * 10/2000 Okada et al. ..... 313/506
6,329,750 B1 12/2001 Hofmann et al. ..... 313/495
6,524,154 B1 * 2/2003 Xia et al. ..... 445/52

* cited by examiner

ANODE SCREEN FOR A PHOSPHOR DISPLAY AND METHOD OF MAKING THE SAME

CROSS REFERENCE TO RELATED APPLICATION

This application is a divisional application of U.S. patent application Ser. No. 09/436,976, filed Nov. 9, 1999 now U.S. Pat. No. 6,570,322, to which priority is claimed under 35 U.S.C. § 120, and which is incorporated herein by reference in its entirety.

BACKGROUND OF THE INVENTION

The present invention relates to a display faceplate. More particularly, the present invention relates to a phosphor screen of a field emission display, wherein a layer of phosphor of the faceplate includes a plurality of openings.

A known display faceplate or phosphor screen, or, hereinafter, anode screen, of a field emission display comprises light permeable conductive material and phosphor layered respectively over a transparent substrate. The anode screen is disposed opposite a cathode emitter plate. Electrons emitted from emitters of the cathode emitter plate impact phosphor of the anode screen and excite the phosphor into illumination by phosphorescence or fluorescence.

Through continued use, electrons accumulate on the surface of the phosphor so as to reduce a voltage potential between a cathode emitter and the phosphor in proportion to the accumulated charge. This lower voltage reduces the acceleration of electrons emitted by the opposite emitters, in turn, limiting the ability of these electrons to obtain velocity and kinetic energy sufficient to excite the phosphor on impact. As a result, image illumination "turn-off" results. This phenomenon becomes more problematic as phosphor developments lead to phosphors of improved flatness, uniformity and resistance, and is especially problematic for monochrome phosphor screens.

In addition to possible image illumination turn-off, some charge of the accumulation is thought to migrate through the phosphor toward an underlying electrode of the anode screen. As the charge migrates through the phosphor, it may react electrochemically with compounds of the phosphor to produce gas contaminates. These gas contaminates are believed at least partially responsible for corrosion of emitters of cathode emitter plates of field emission displays. Furthermore, the electrochemical reactions are also thought to affect the color or intensity of the phosphor's phosphorescence.

SUMMARY OF THE INVENTION

The present invention provides a new anode screen and a field emission display. Such anode screen may be known alternatively as a faceplate assembly, an anode phosphor screen, a display faceplate and the like, or simply a faceplate. The present invention recognizes and addresses some disadvantageous of exemplary anode screens of the prior art, including aspects thereof, e.g., wherein a phosphor layer experiences image illumination turn-off, or wherein electrochemical reactions occur within the phosphor.

In accordance with one embodiment of the present invention, a faceplate assembly comprises phosphor layered over a substrate. Walls of the phosphor define a plurality of openings therethrough. Preferably, a light permeable conductive material is layered between the substrate and phosphor.

In accordance with one aspect of this exemplary embodiment, a group of openings of said plurality define, at least in part, a pixel region of the phosphor. Preferably, the openings of the group delimit the pixel region with a shape of a hexagon.

In accordance with another exemplary embodiment of the present invention, a monochrome field emission display comprises a cathode emitter plate with a plurality of electron emitters disposed in spaced and opposing relationship to an anode screen. The anode screen comprises a layer of phosphor that faces the plurality of emitters of the cathode emitter plate. Walls of the phosphor define a plurality of holes through the phosphor. Preferably, a group of holes of the plurality surround a pixel region of the phosphor opposite an associated emitter of the cathode emitter plate.

These and other features of the present invention will become more fully apparent in the following description and independent claims, or may be learned by the practice of the invention as set forth hereinafter.

BRIEF DESCRIPTION OF THE DRAWINGS

The present invention will be understood from reading the following description of the particular embodiments with reference to specific embodiments illustrated in the intended drawings. Understanding that these drawings depict only particular embodiments of the invention and are not therefore to be limiting of its scope, the invention will be described and explained with additional detail through use of the accompanying drawings in which.

DETAILED DESCRIPTION OF THE PREFERRED EMBODIMENTS

Reference will now be made to drawings wherein like structures are provided like reference designations. The referenced drawings provide representative, non-limiting diagrams of select embodiments of the present invention and may not necessarily be drawn to scale.

The present invention relates to an anode screen for a phosphor field emission display. Such anode screen may be alternatively known, for example, as an anode phosphor screen, phosphor screen, display faceplate, faceplate assembly, or simply a faceplate. Hereinafter, for purposes of the present disclosure, the phosphor screen will be referred to as an anode screen.

Figure 1:
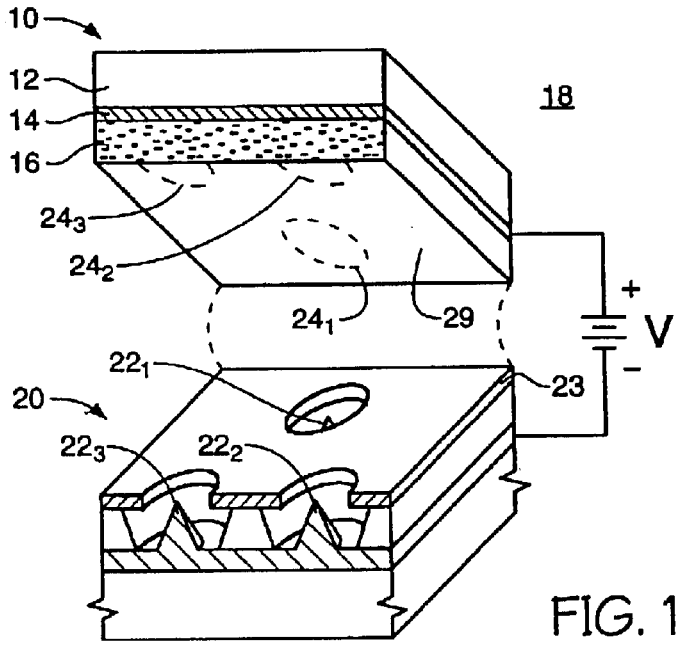
FIG. 1 (PRIOR ART)
FIG. 1 is a partial cross-section and isotropic view of a prior art field emission display.

Referencing FIG. 1, an exemplary, prior art, field emission display 18 (FED) comprises an anode screen 10 disposed in spaced, opposing and substantially parallel relationship to cathode emitter plate 20. A plurality of electron emitter sources 22, hereinafter emitters 22, are distributed across an emission area of cathode emitter plate 20. Emitters 22, when biased appropriately, emit electrons toward opposing pixel regions 24 of phosphor 16 of the anode screen 10. Exemplary, prior art, cathode emitter plates and associated methods of fabrication are disclosed in U.S. Pat. Nos. 5,866,979 and 5,783,910; and U.S. patent application Ser. No. 09/096,085, entitled "Field Emission Device with Buffer Layer and Method of Making", filed Jun. 11, 1998, the disclosures of which are incorporated by reference.

Figure 2:
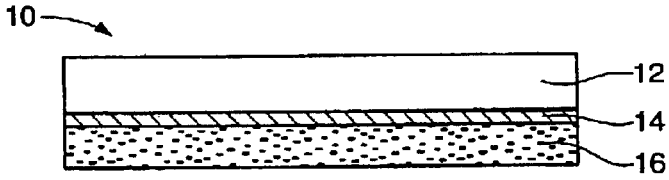
FIG. 2 (PRIOR ART)
FIG. 2 is a cross-section view of a prior art anode screen.

Further referencing FIGS. 1–2, anode screen 10 comprises substrate 12 of a transparent and insulating material, such as glass. Translucent conductive material 14 and phosphor 16 respectively are layered over substrate 12. Regarding the terms "transparent" and "translucent," for purposes of the present disclosure, and subsequent claims, "transparent" characterizes, generally, a property of transmitting light without appreciable scattering, especially light of the visible spectrum, i.e., 400 to 700 nanometer wavelength. Similarly, "translucent", as used herein, refers, generally, to a property of permitting the passage of light, or, in other words, a property of being permeable to light, especially light of the visible spectrum between 400 to 700 nanometers wavelength.

When the exemplary prior art display is in use, referencing FIG. 1, a voltage V of about 1000 volts is applied between translucent conductive material 14 of anode screen 10 and at least one emitter 22 of cathode emitter plate 20. A gate voltage (of a voltage source not shown) is applied to gate electrode 23 of the cathode emitter plate 20 to assist emission of electrons from emitter 22. Electrons emitted from the emitter impact a pixel region 24 of the phosphor 16 of anode screen 10. Ideally, energy of the impinging electrons transfer to the phosphorescent material of phosphor 16 and excite electrons of the phosphorescent material into their high-energy, photon emission states—i.e., thereby effecting fluorescence or phosphorescence.

For an exemplary prior art, phosphor anode screen 10, continuing with reference to FIG. 1, continued operation of display 18 may result in charge accumulation at pixel regions $\mathbf{24}_1$, $\mathbf{24}_2$, $\mathbf{24}_3$ on surface 29 of phosphor 16. More specifically, electrons emitted from emitter 22 accumulate on the surface of phosphor 16 at pixel region $\mathbf{24}_1$. Likewise, electrons emitted from emitters $\mathbf{22}_2$, $\mathbf{22}_3$ accumulate at pixel regions $\mathbf{24}_2$ and $\mathbf{24}_3$ respectively. If charge continues to accumulate at these pixel regions, the surface potential at these pixel regions changes in proportion to the collected charge so as to lower the local voltage available at these pixel regions. This reduction of the local voltage decreases the acceleration of electrons that are emitted by opposite emitters 22, which, in turn, limits the ability of these electrons to obtain sufficient velocity and kinetic energy for sustained excitation and phosphorescence at the affected pixel regions. Accordingly, such exemplary, phosphor screens of the prior art exhibit image "turn-off", wherein a region of the screen may discontinue image illumination.

Additionally, it is theorized that some electrons of these accumulations migrate through the layer of phosphor toward the electrode beneath the phosphor layer. The migrating electrons are thought to react electro-chemically with compounds of the phosphor so as to produce and release gas contaminates. These gas contaminates might then corrode and shorten the life of emitters 22 of cathode emitter plate 20 of the associated display assembly. Further, such electrochemical reactions are believed to affect the color and/or intensity of the fluorescence and/or phosphorescence of phosphor 16.

Recognizing the difficulties of such exemplary, phosphor anode screens of the prior art, the present invention proposes a new anode screen for a phosphor field emission display. In accordance with one exemplary embodiment of the present invention, an anode screen comprises a substantially continuous layer of phosphor. A display region of the layer of phosphor includes a plurality of openings. These openings pass through the layer of phosphor and provide windows that expose portions of an underlying electrode layer.

Figure 3:
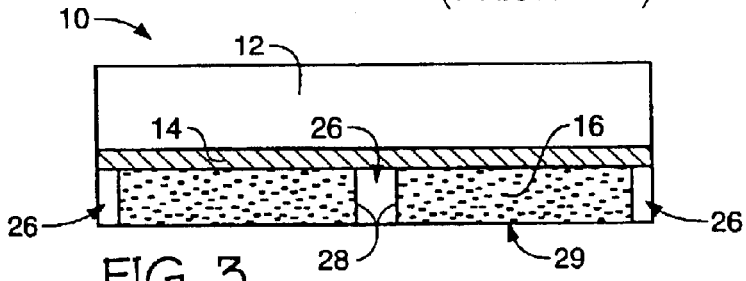
FIG. 3 is a partial cross-section view showing openings in a phosphor layer of an anode screen of an exemplary embodiment of the present invention.
Figure 4A:
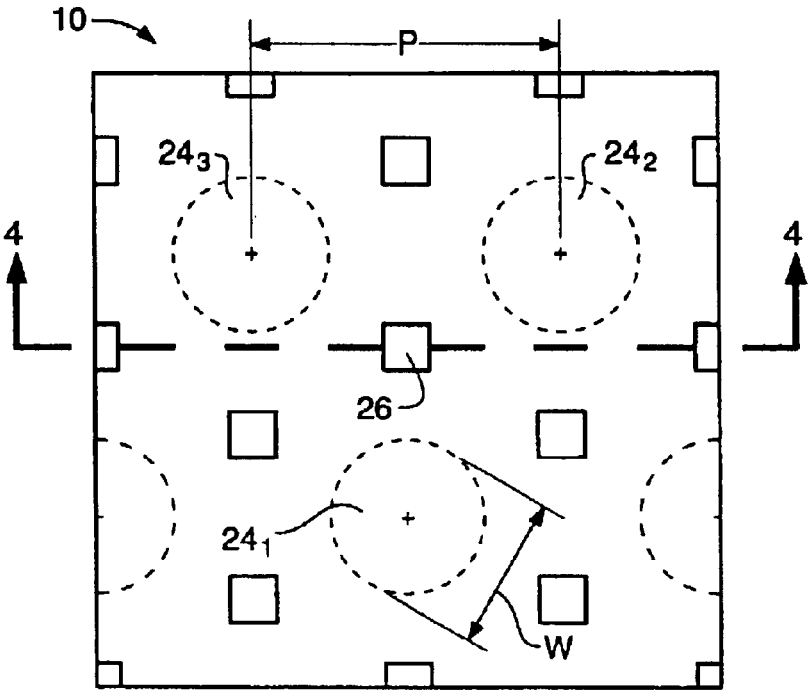
FIG. 4A is a plan view of a phosphor anode screen showing a plurality of openings defined in a phosphor layer of the anode screen in accordance with an exemplary embodiment of the present invention.
Figure 4B:
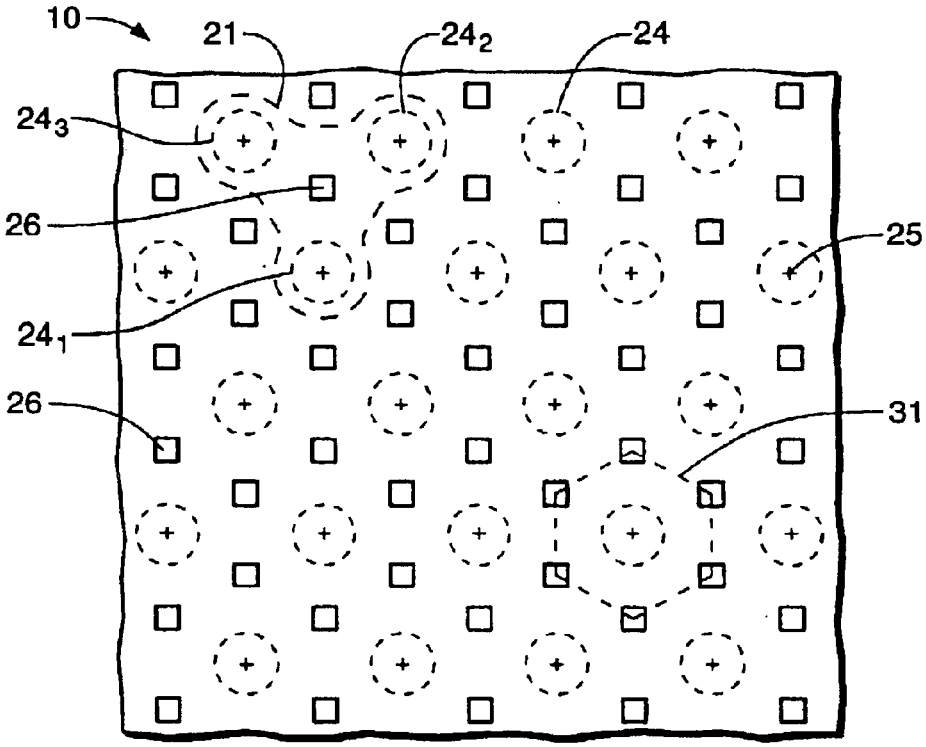
FIG. 4B is a plan view similar to that of FIG. 4A, showing pixel regions amongst openings of a phosphor layer for a phosphor anode screen of an exemplary embodiment of the present invention.
Figure 5:
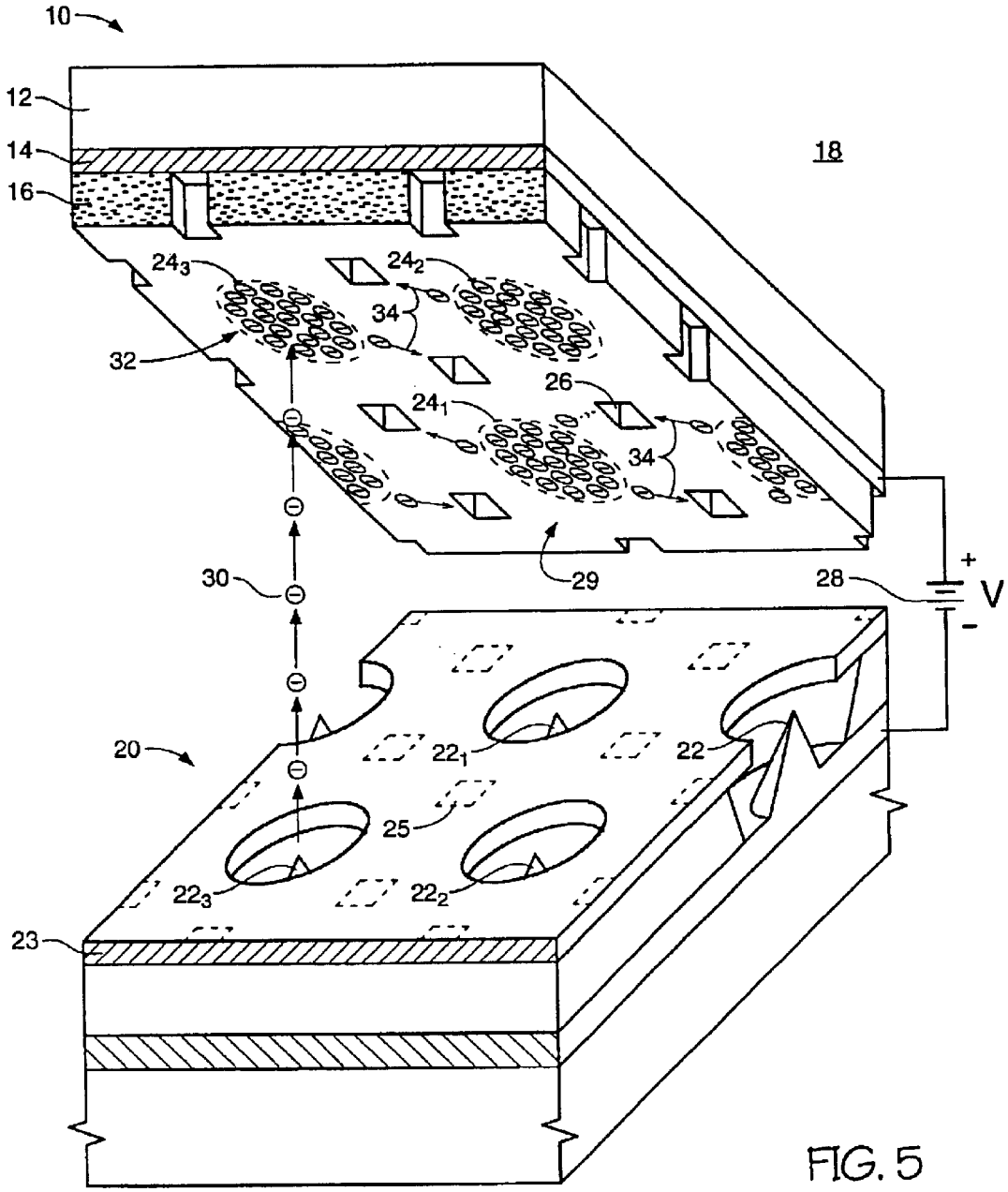
FIG. 5 is a partial cross-section and isometric view showing a phosphor anode screen disposed relative a cathode emitter plate for a field emission display exemplifying an embodiment of the present invention.

Referencing FIGS. 3–5, representative of exemplary embodiments of the present invention, anode screen 10 comprises translucent conductive material 14 layered over and against substrate 12. Preferably, substrate 12 comprises transparent and insulating material such as glass. More preferably, substrate 12 comprises borosilicate glass, for example, such as that which is available from Owens Coming under model number 1737. In alternative exemplary embodiments, substrate 12 comprises other glass, such as soda lime glass. However, alternative substrate types should be chosen to withstand process temperatures as may be required during fabrication of the anode screen. Such fabrication procedures will be more fully described subsequently hereinafter relative other embodiments of the present invention.

Continuing with an exemplary embodiment of the present invention, substrate 12 preferably includes known frit or spacer structures which are to be incorporated within the field emission display between the substrate of the anode screen and the opposite cathode emitter plate. The frit and spacer structures enable formation of a chamber between the two substrates while maintaining a space therebetween that may be evacuated of gases without collapse.

Figure 17:
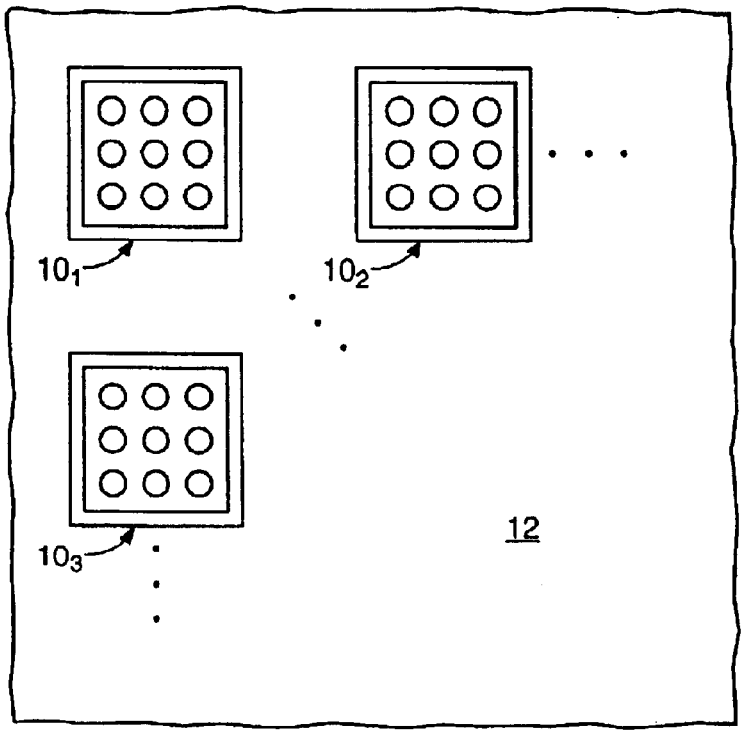
FIG. 17 is a plan view of a "multi-up" illustrating a plurality of anode screens fabricated over respective active regions of a transparent substrate, in accordance with an exemplary embodiment of the present invention.

Turning forward to FIG. 17, in a preferred exemplary embodiment, substrate 12 extends an area sufficient for encompassing a plurality of anode screens $\mathbf{10}_1$, $\mathbf{10}_2$, $\mathbf{10}_3$ . . . Preferably, such large area substrate is formed with a plurality of known frits and spacers, as described above in the preceding paragraph. These frit and spacer structures are formed together with accompanying known electrode anode patterns so as to establish a plurality of display regions or active regions upon the substrate by which to fabricate respective plurality of anode screens $\mathbf{10}_1$, $\mathbf{10}_2$, $\mathbf{10}_3$ . . . In FIG. 17, large circles are shown representative of the plurality of openings in the layer of phosphor. These circles merely exemplify the openings and, accordingly, may not be drawn to scale, nor do the circles necessarily delimit their outline shapes. In other exemplary embodiments, the holes are formed with an alternative shape, e.g., of rectangular, elliptical, triangular, diamond or other outline. Hereinafter, such large area substrate 12, together with the plurality of frits, spacers and active regions, will be referred to as a "multi-up."

In an exemplary embodiment of the present invention, returning with reference to FIGS. 3–5, conductive layer 14 comprises material permeable to light such as indium-tin-oxide (ITO) or tin-oxide (TO) of thickness less than 2000 angstroms, and more preferably, tin-oxide of between 200–1500 angstroms. In alternative embodiments, the conductive material 14 comprises a thin, translucent layer of zinc oxide or the like. Over the surface of conductive material 14, a substantially continuous layer of phosphor 16 is formed. Walls 28 of phosphor 16, as show in FIG. 3, define a plurality of holes 26 through the layer of phosphor 16—i.e., providing windows that expose corresponding regions of conductive material 14.

Again, as described earlier herein, pixel regions 24 of phosphor 16, with reference to FIG. 5, correspond to regions of the phosphor 16 capable of bombardment by electrons 30 as emitted from opposing emitters 22 of cathode emitter plate 20, when the anode screen 10 and the cathode emitter plate 20 are assembled and operating together within a field emission display. To better facilitate an understanding of this concept, such exemplified pixel areas have been loosely delimited by phantom lines 24 of FIGS. 4A, 4B and 5.

In a preferred exemplary embodiment, referencing FIG. 4B, each group 21 of three adjacent pixel regions $\mathbf{24}_1$, $\mathbf{24}_2$, $\mathbf{24}_3$ of phosphor 16 have a hole 26 therebetween. Hole 26 passes through the phosphor and exposes a region of the underlying electrode between the adjacent pixel regions. Preferably, hole 26 is positioned equidistant centers of the adjacent pixel regions. As shown in FIGS. 4A and 4B, the pixel regions 24, established in accordance with placement of opposing emitters 22 of cathode emitter plate 20, are disposed as a plurality of even and odd rows that are offset one from the other. Relative these even and odd rows, holes 26 provide groupings 31, as shown in FIG. 4B, of six holes 26 per group 31. The holes 26 of each group 31 surround, at least in part, their respective pixel region 24. Preferably, the holes 26 of at least one group 31 define a hexagon shape for a region of phosphor 16 established as their associated pixel 24. Ideally, the centers of the holes 26 locate the apexes of the hexagon shape.

In accordance with alternative embodiments of the present invention, pixel regions of the phosphor layer are established between groups of at least three holes. For example, centers of three equally spaced holes outline a triangular shape of phosphor encompassing at least part of an associated pixel region of the phosphor. In accordance with another exemplary embodiment, four holes per group locate corners of rectangular shapes, or alternatively diamond shapes, that encompass respective pixel regions within.

For purposes of facilitating a better understanding of the present invention, representative dimensions of an anode screen for an exemplary embodiment are described with reference to FIG. 4A. Again, pixel regions 24 have illumination widths or diameters defined in accordance with the regions of phosphor capable of excitation by emitted electrons of opposite emitters 22. The illumination widths depend upon a variety of factors including, but not limited to, the phosphorescent efficiency of phosphor 16, the spacing of anode screen 10 relative cathode plate 20, the voltage bias between anode electrode 12 relative cathode emitters 22, the voltage bias of gate electrode 23, and others. For a particular exemplary embodiment of the present invention, a pixel region 24 of phosphor 16 is characterized with an illumination width W of about 20 micrometers, and a plurality of pixel regions 24 a pitch P of about 30 micrometers between centers. Given these dimensions, when (at least one) hole 26 is provided equidistant, the centers of the three adjacent pixel regions $\mathbf{24}_1$, $\mathbf{24}_2$, $\mathbf{24}_3$ of pixel group 21, the center of hole 26 resides about 17 micrometers from the centers of the three adjacent pixel regions $\mathbf{24}_1$, $\mathbf{24}_2$, $\mathbf{24}_3$.

Holes 26 have widths less than 40% of their distance therebetween. Further to the above exemplary embodiment, holes 26 have diameters less than 10 micrometers. More preferably, the walls of holes 21 define a rectangular outline of width-length dimensions of about 4×6 micrometers. In alternative embodiments, holes 26 comprise other outlines, such as, e.g., circular, elliptical or triangular.

Furthermore, as shown in FIG. 3, the sidewalls 28 which define hole 26 in phosphor 16, extend substantially perpendicularly relative to the exposed surface of conductive material 14. In alternative exemplary embodiments, sidewalls 28 having slopes (not shown) that are not perpendicular to the surface of conductive material 14. In some aspects of such exemplary alternative embodiments, sidewalls 28 comprise convex or concave profiles (not shown) per their side-view cross-sections.

In the exemplary drawings of the present disclosure, anode electrode 14 of anode screen 10 is shown as comprising a continuous layer of translucent conductive material 14. In alternative embodiments of the present invention, the anode electrode of anode screen 10 comprises a fine mesh (not shown) of conductive material.

Figure 3B:
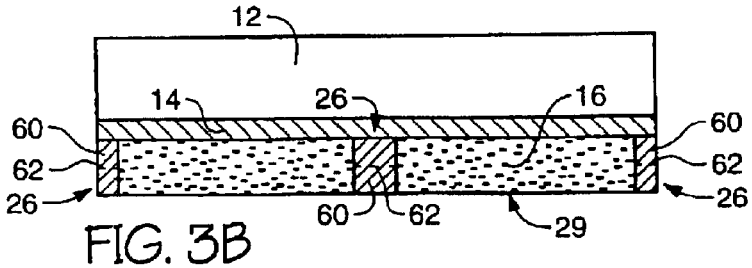
FIG. 3B is a partial cross-section view of an alternative embodiment of the present invention wherein conductive material at least partially fills openings of a phosphor layer of an anode screen.

In accordance with another alternative embodiment of the present invention, referencing FIG. 3B, known conductive material 60 at least partially fills hole 26. Per one aspect of this embodiment, conductive material 60 can be formed using a known, selective chemical vapor deposition (CVD) process for depositing the conductive material upon regions of the anode electrode 14 exposed through holes 26 of phosphor 16. In accordance with an alternative aspect, conductive material is deposited over the exposed portion of the anode electrode 14 using a known electrolysis plating procedure. In a preferred embodiment, metal is deposited over the entire structure using a normal CVD process and then etched back to remove metal from over the top of phosphor 16 while leaving metal within holes 26. Although conductive material 60 is shown in FIG. 3B with a height that fills hole 26 to the height of phosphor 16, it will be understood that conductive material 60, in accordance with other embodiments, can be formed with a partial-fill height 62 below that of phosphor 16.

Continuing with reference to FIG. 5, in accordance with an exemplary embodiment of the present invention, a field emission display 18 comprises phosphor anode screen 10 disposed in spaced, opposing, and substantially parallel relationship relative to cathode emitter plate 20. In a method of operating the field emission display, voltage source 28 applies a potential between anode electrode 14 of anode screen 10 relative at least one emitter 22 of cathode emitter plate 20. Preferably, anode screen 10 is positioned relative cathode emitter plate 20 such that the peripheral outlines of holes 26 (i.e., voids, windows or openings) when projected perpendicularly onto the surface of the cathode emitter plate 20, will provide shadows 25 that land upon the surface of the cathode emitter plate substantially equidistant centers of neighboring emitters $\mathbf{22}_1$, $\mathbf{22}_2$, and $\mathbf{22}_3$.

Figure 6:
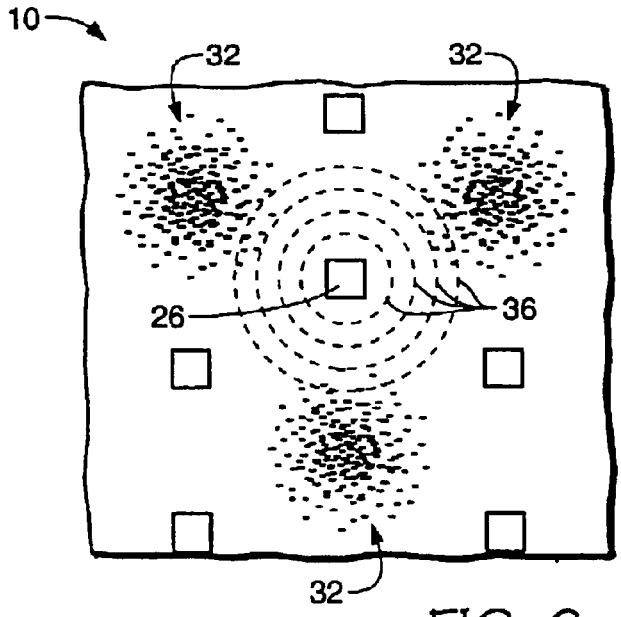
FIG. 6 a partial plan view of a phosphor anode screen of an exemplary embodiment of the present invention, schematically illustrating theorized charge accumulations at pixel regions on a surface of a phosphor layer of an anode screen.
Figure 7:
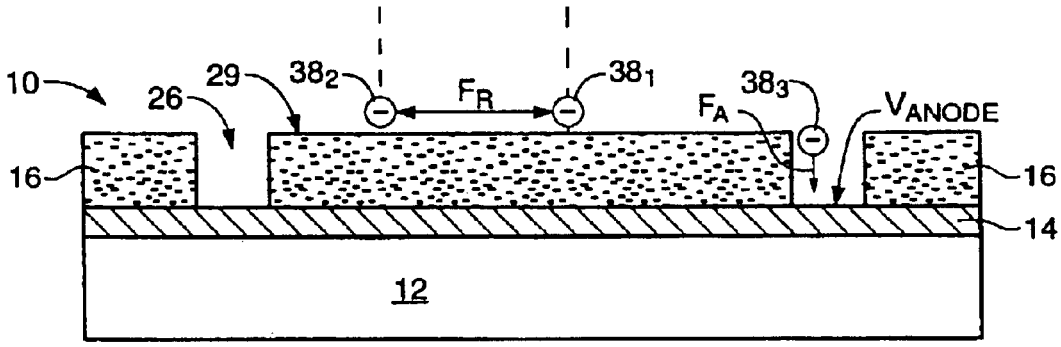
FIG. 7 is a partial cross-section of a phosphor anode screen representative of an exemplary embodiment of the present invention, illustrating theorized forces of attraction and repulsion that may act upon charges over a surface of phosphor of the anode screen.

In operation, referencing FIGS. 5–7, it is theorized that electrons 30 emitted from, for example, emitter $\mathbf{22}_3$ of cathode emitter plate 20 travel toward anode screen 10 and bombard phosphor at pixel region $\mathbf{24}_3$. As emitter $\mathbf{22}_3$ continues emitting electrons 30, electrons collect on surface 29 of phosphor 16 at pixel region $\mathbf{24}_3$ and add to a charge accumulation 32. As the accumulation builds, a voltage potential at the pixel region changes proportionately. Exposed regions of conductive material 14—i.e., exposed by holes 26—exhibit voltage potentials more positive than neighboring accumulations 32. Therefore, as shown by the schematically illustrated equal-potential lines 36 of FIG. 6, holes 26 are deemed potential wells that attract charge of accumulations 32.

More specifically, referencing FIG. 7, negative charge $\mathbf{38}_3$ of an accumulation 32 is attracted toward the potential well of hole 26 with an attraction force $F_A$ inversely proportional to its distance from the potential well and directly proportional to the potential thereof. Additionally, a repulsion force FR acts upon and between neighboring like charges $\mathbf{38}_1$, $\mathbf{38}_2$. These attractive and repulsive forces facilitate movement of charge across the surface of phosphor 16 so as to drain charge 38 from the surface of phosphor 16 to potential wells (of holes 26), thereby limiting accumulations and associated voltage reductions at the surface 29 of phosphor 16. Additionally, it is theorized that the potential wells of holes 26 reduce migration of charge through the phosphor.

Figure 8:
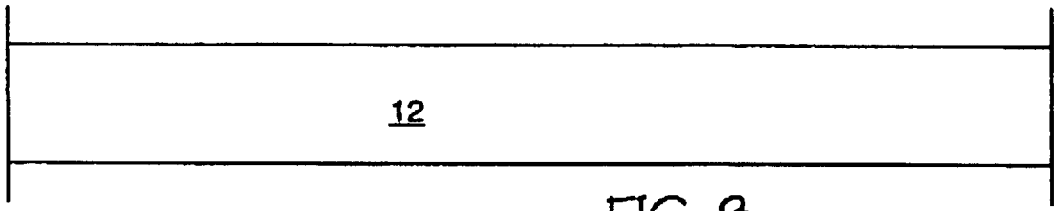
FIG. 8 is a cross-section view showing a substrate to be used in the formation of a phosphor anode screen.
Figure 9:
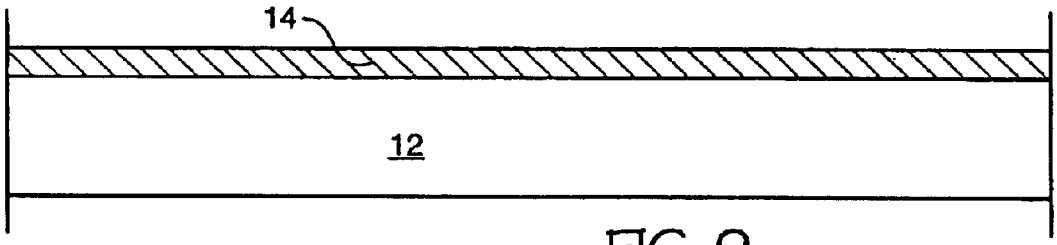
FIG. 9 is a cross-section view of the substrate of FIG. 8 after further processing, showing deposited layer of light permeable conductive material.

Turning now to methods of fabricating a phosphor anode screen, beginning with reference to FIGS. 8 and 9, in accordance with an exemplary embodiment of the present invention, light permeable conductive material 14 is layered over a transparent substrate 12, which preferably comprises borosilicate glass. Again, as mentioned earlier herein, light permeable conductive material 14 preferably comprises one of indium tin oxide, tin oxide, cadmium oxide, zinc oxide and the like of less than 2000 angstroms. More preferably, light permeable conductive material 14 comprises tin oxide of thickness between 200–1500 angstroms.

Light permeable conductive material 14 is deposited and patterned over transparent substrate 12 using known methods to provide an anode electrode for anode screen 10. See U.S. patent application Ser. No. 09/046,069, filed Mar. 23, 1998, entitled "Electroluminescent Material and Method of Making Same", incorporated herein by reference. Preferably, deposition and patterning of the light permeable conductive material defines a plurality of active regions over a large and continuous, transparent substrate to provide what is known as a "multi-up", as presented earlier herein. Additionally, substrate 12 preferably comprises known frit and spacer structures. In the assembly of a field emission display, to be described more fully subsequently hereinafter, the frit and spacer structures are positioned between the substrate of the anode screen and the cathode emitter plate.

Figure 10:
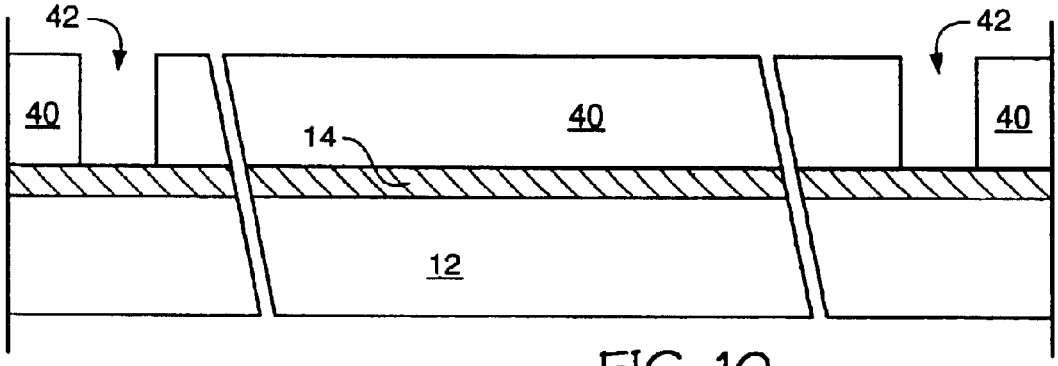
FIG. 10 is a cross-section view of the substrate and conductive material of FIG. 9 after further processing, showing definition of a patterned mask.

Returning to the method of fabricating the phosphor anode screen, with reference to FIG. 10, a mask 40 is formed over light permeable conductive material 14 and patterned with openings 42. Openings 42 are formed in the photoresist mask 40 using known photolithographic processes, wherein photoresist is layered over the conductive material 14 and patterned per an imaging reticle (not shown) to establish hardened and unhardened regions in the layer of photoresist. The imaged photoresist is then developed to form openings 42 in accordance with the hardened and unhardened regions of the imaged photoresist.

Figure 11:
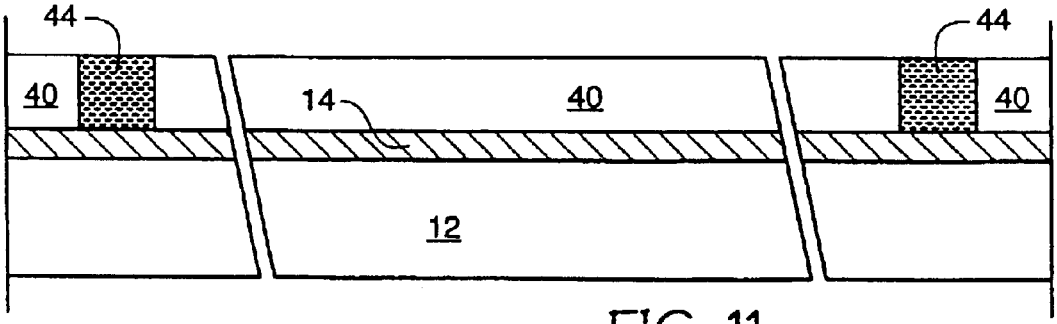
FIG. 11 is a cross-section view of the substrate structure of FIG. 10 after further processing, showing deposition of black material.

Referencing FIGS. 10 and 11, black material 44 is formed over select regions of light permeable conductive material 14. The select regions are defined in accordance with the openings 42 of mask 40. The black material is deposited using known electrophoretic deposition. In a particular exemplary embodiment, black material comprises substantially opaque and electrically insulating material. For example, black material may comprise glass particles having metal oxide impurities therein which blacken when oxidized so as to be absorbing or non-reflective of light. Deposition of black material begins with preparation of an electrophoretic solution. An exemplary electrophoretic solution for the deposition of the black material comprises:

- isopropyl alcohol of 98–99.5 weight percent, and preferably about 99.5 weight percent;
- an electrolyte, such as a salt of magnesium, zinc, aluminum, indium, lanthanum, cerium, or yttrium of 0.001–0.1 weight percent, and more preferably cerium nitrate hexahydrate, of about 0.1 weight percent;
- optionally, glycerol of 0.001–0.1 weight percent; and black material comprising material such as copper, cobalt, or iron oxide or combinations thereof of up to about 0.01–1.0 weight percent, and more preferably cobalt oxide of about 0.4 weight percent.

U.S. Pat. No. 5,762,773, also incorporated by reference, discloses other alternative compounds and processes for deposition of black material, such as boron carbide, lead oxide, niobium oxide, palladium oxide, rhenium oxide, tungsten carbide, silicon carbide, vanadium carbide, copper oxide, boron silicide, chrome oxide, germanium oxide, iridium oxide, titanium oxide, manganese carbide, manganese phosphide, manganese tantalate, osmium oxide, strontium boride, strontium carbide, thorium silicide, molybdenum oxide, molybdenum sulfide, and praseodymium manganese oxide.

After providing the solution for depositing the black material, substrate 12 with mask 40, as shown in FIG. 10, is submerged into the electrophoretic solution and a voltage of about 50 to 200 volts applied between the electrodes of the electrophoretic process. The electrode voltages are applied, e.g., for about one minute, and black material deposited upon regions of the light permeable conductive layer 14, as permitted through holes 42 of mask 40. Typically, the black material is deposited to a depth of between 0.25–10 μm, and more preferably 0.4–1.0 μm. Known patterning of the mask provides patterned deposition of black material to form a frame or border around a display region of the anode screen.

After depositing black material 44, photoresist 40 is stripped using, for example, known oxygen plasma, or, alternatively, a known solvent resist removal process. In a preferred embodiment, the photoresist is removed using an oxygen plasma comprising a pressure of about 1 torr, an applied RF power of between 400 to 500 watts, and gases of oxygen and nitrogen.

Figure 12:
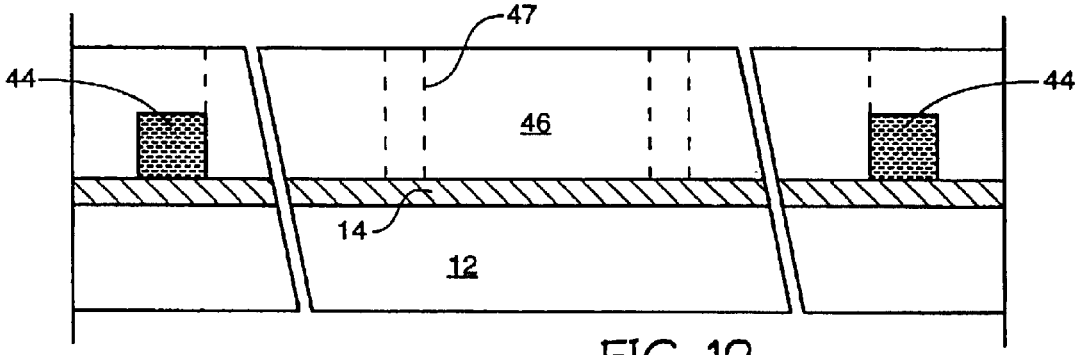
FIG. 12 is a cross-section view of the substrate of FIG. 11, after further processing, showing layering of second photoresist.
Figure 13:
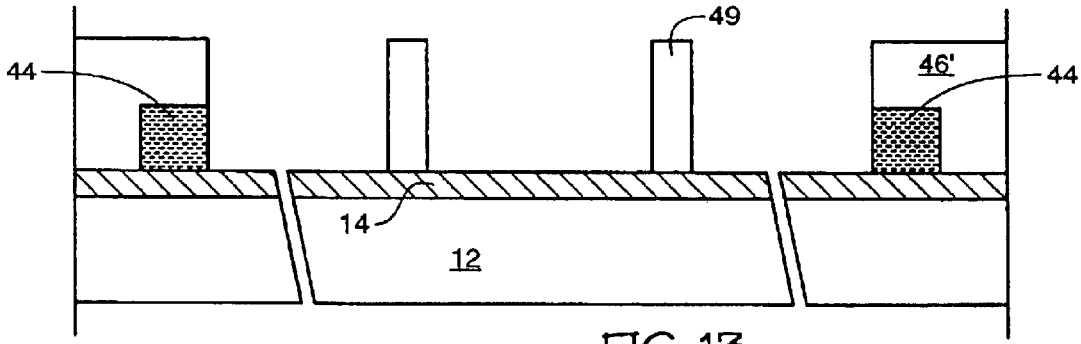
FIG. 13 is a cross-section view of the substrate of FIG. 12 after further processing, showing definition of a second mask.

After removing the first photoresist 40, continuing with reference to FIGS. 12 and 13, second photoresist 46 is deposited over the black material 44, light permeable conductive material 14 and substrate 12. As represented by dashed lines 47 of FIG. 12, select regions of the second photoresist 44 are radiated to define hardened and unhardened regions of photoresist. The exposed photoresist 46 is then developed, using known photoresist development processes, to remove portions of the photoresist and form second mask 46' comprising pillars or columns 49 as shown in FIGS. 13–14.

In a preferred exemplary embodiment of the present invention, photoresist 46 comprises Shell EPON resin available by model number SU-8, an initiator of cyracure of Union Carbide available by model number UVI-6990, and a solvent vehicle of gamma-butyrolactone. Imaging of such photoresist preferably comprises exposure by known, ultraviolet photolithography.

Figure 14:
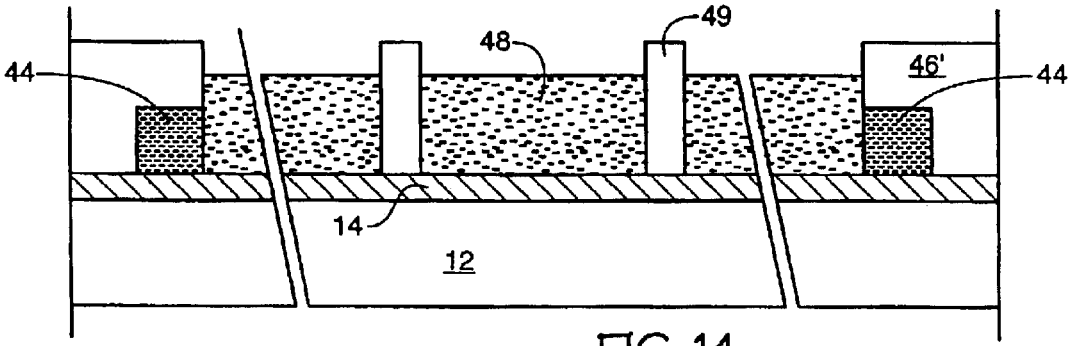
FIG. 14 is a cross-section view of the substrate of FIG. 13 after further processing, showing phosphor deposition.

Continuing with reference to FIG. 14, phosphor 48 is deposited over select regions of light permeable conductive material 14 as permitted by mask 46'. During deposition of phosphor 48, pillars or columns 49 of mask 46' prevent deposition over select regions of conductive material 14, that are to be associated with the formation of openings through the layer of phosphor 48. Similar to deposition of the black material, phosphor 48 is deposited using known electrophoretic deposition procedures. In an exemplary embodiment, the electrophoretic deposition of phosphor employs an electrophoretic solution comprising:

- a solvent of isopropyl alcohol of about 93–99.5 weight percent;
- a binder electrolyte of cerium nitrate hexahydrate of 0.001–1.0 weight percent, and preferably about 0.01 weight percent;
- glycerol of 0.001–1 weight percent, and preferably about 0.2 weight percent; and
- a known phosphor compound of 0.1–5.0 weight percent, and preferably about 0.75 weight percent.

The phosphor compound comprises a known phosphorescent material selected in accordance with a desired color for the monochrome display. Exemplary phosphorescent compounds include, but are not limited to, europium-activated yttrium-oxide $Y_2O_3$: Eu, manganese-activated zinc silicate $Zn_2SiO_4$: Mn, and silver-activated zinc sulfide ZnS:Ag. Previously incorporated by reference, U.S. Pat. No. 5,762,773 discloses other exemplary known phosphors.

During phosphor deposition, the masked substrate, e.g., as shown by FIG. 13, is submerged into the electrophoretic solution. A voltage of between 50 to 200 volts is applied between the electrodes of the electrophoretic process for depositing phosphorescent material against regions of light permeable conductive material 14 as permited per mask 46'. In a preferred exemplary embodiment, the electrophoretic deposition process is maintained for about one minute and deposits phosphor to a thickness of up to 20 μm, and, more preferably, between 5 to 8 μm.

Next, solvent, such as, e.g., isopropyl alcohol, is evaporated from the deposited phosphor 48. In accordance with one aspect of an exemplary embodiment, the phosphor is dried in a standard atmospheric ambient. Alternatively, the substrate is spun in a known spin dryer which assists evaporation of the solvent from the deposited phosphor.

Figure 15:
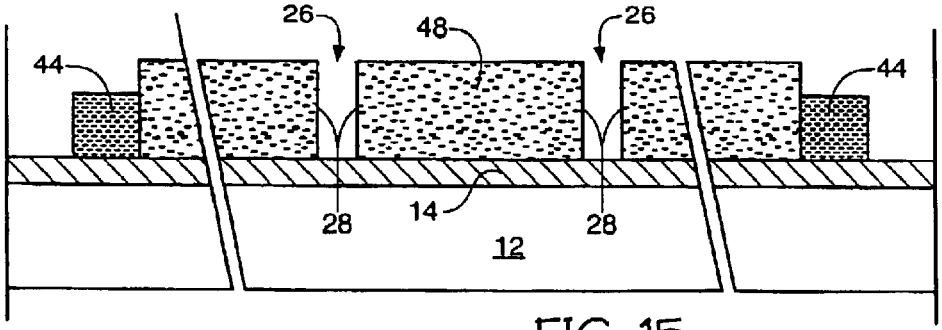
FIG. 15 is a cross-section view of the substrate of FIG. 14 after further processing, showing the defined openings within the deposited phosphor.

Continuing with reference to FIG. 15, photoresist mask 46' is removed, preferably, by a known oxygen plasma, similarly as disclosed earlier herein relative to removal of the first photoresist 40.

In accordance with another optional, or alternative, exemplary embodiment of the present invention, a binder (not shown) is applied to phosphor 48 using a binder solution, for example, comprising a solvent or vehicle solution such as isopropyl alcohol having suspended therein an organosilicate binder such as Techniglas GR-650F of 0.01–5 weight percent, and more preferably about 0.25 weight percent. Preferably, the binder solution is applied to phosphor 48 using a known spin-coat procedure. Alternatively, the binder is layered over the phosphor employing a dip process. In an exemplary dip process, the substrate and phosphor are submerged into the binder solution. Thereafter, the substrate is withdrawn from the solution, preferably, with its surface perpendicular to that of the solution bath. In such exemplary embodiment, the substrate is pulled from the solution using a pull rate (or speed of withdrawal) of about one inch of substrate withdrawal per minute. Although the binder has been disclosed a being applied to the phosphor after the photoresist mask has been removed, in alternative aspects, the binder is applied before removing the photoresist. In yet another alternative aspect, binder is incorporated into the electrophoretic solution of the phosphorescent material.

Thus far, the deposition of phosphor has been described as employing electrophoretic plating procedures. Alternatively, the phosphor may be deposited using other known phosphor depositing methods such as dusting, screen printing, and/or photo-tackey.

Next, in accordance with an optional aspect of the present embodiment, the substrate with phosphor is placed in an oven and the phosphor exposed to a bake temperature of at least 300° C. Preferably, the phosphor is exposed to a bake temperature of between 500–700° C., and more preferably, about 700° C. In accordance with one aspect of this embodiment, the substrate with phosphor is placed on a web or belt of a known belt furnace and carried through the furnace on the belt to receive a total temperature ramp-up and ramp-down duration of about 2½ hours.

In a preferred exemplary embodiment, transparent substrate 12 comprises borosilicate glass and the phosphor is exposed to a bake temperature of about 700° C. In an alternative embodiment of the present invention, substrate 12 comprises soda lime glass and the phosphor is exposed to a bake temperature between 400 to 450° C.

Figure 16:
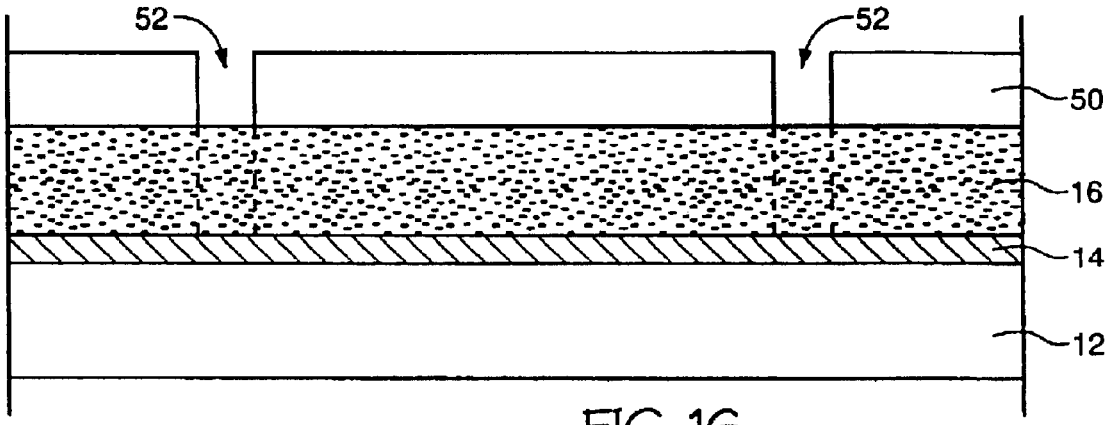
FIG. 16 is a cross-section view of the substrate structure of FIG. 9 after further processing, representing an alternative method of forming holes in a phosphor layer in accordance with an exemplary embodiment of the present invention.

In accordance with an alternative embodiment of the present invention, turning to FIG. 16, light permeable conductive material 14 and phosphorescent material 16 are layered respectively over transparent substrate 12. Mask 50 is formed with apertures 52 over phosphor 16 using, for example, known photolithographic processes. Portions of phosphor 16 are then etched in accordance with apertures 52 of mask 50 until defining openings 26 in phosphor 16.

Thereafter, mask 50 is removed, leaving holes 26 in phosphor 16 of the anode screen 10 as shown in FIG. 15.

Thus far, the methods of fabricating the anode screen have been described, primarily, with reference to a single anode screen. However, in a preferred exemplary embodiment of the present invention, the phosphor and black materials are deposited and patterned upon multiple "active regions" across a continuous substrate 12, such as, for example, a "multi-up". Thus, a plurality of phosphor anode screens $\mathbf{10}_1$, $\mathbf{10}_2$ . . . are formed over substrate 12 as shown schematically in FIG. 17. Each of the plurality of anode screens $\mathbf{10}_1$, $\mathbf{10}_2$, . . . are then singulated into separate phosphor anode screens 10, using known singulation methods.

Figure 18:
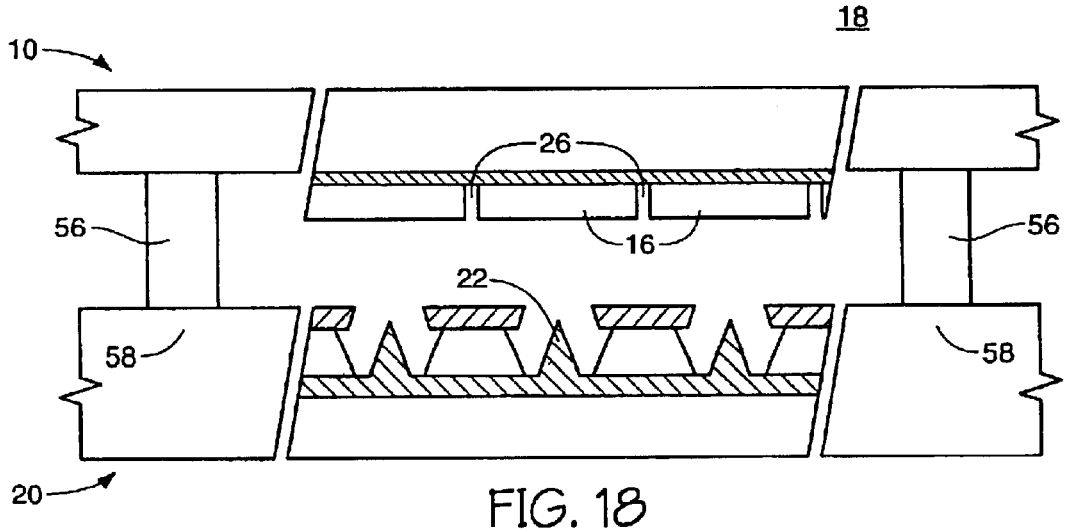
FIG. 18 is a cross-section view of a field emission display, illustrating placement of an anode screen over a cathode emitter plate during assembly of a field emission display in accordance with a further exemplary embodiment of the present invention.

In a further exemplary embodiment of the present invention, referencing FIG. 18, phosphor anode screen 10 is joined with a known cathode emitter plate 20. Known semiconductor die (e.g., flip-chip) assembly and alignment tools facilitate this assembly. When positioning anode screen 10 against cathode emitter plate 20, boundary or border 58 of cathode emitter plate 20 are designed to meet frits 56. During assembly, cathode emitter plate 20 is mounted as a die upon the phosphor anode screen. Predetermined design of emitters 22 relative boundary 58 of cathode emitter plate 20 and holes 26 relative frits 56 of anode screen 10, assure that frits 56 seat upon the cathode plate such that holes 26 within the phosphor 16 of anode screen 10 are positioned (as designed) preferably equidistant and about respective pixel regions of phosphor 16, as described earlier herein relative to FIGS. 4A and 4B.

Additionally, in accordance with another embodiment, known spacers (not shown) are disposed between the substrate 12 of anode screen 10 and the cathode emitter plate 20 of the field emission display 18, preferably, as elements of anode screen 10. These spacers maintain a spaced relationship of the phosphor of anode screen 10 above cathode emitter plate 20. The anode screen and cathode emitter plate, taken together with the spacers and frits, define a chamber that is evacuated of gases. The spacers structurally support the anode screen in spaced relationship over the cathode emitter plate; thereby preventing collapse of the evacuated chamber.

Although the forgoing invention has been described with respect to certain exemplary embodiments, other embodiments will become apparent in view of the disclosure herein. Accordingly, the described embodiments are to be considered only as illustrative and not restrictive. The scope of the invention, therefore, is indicated by the appended claims and there combination in whole or in part rather than by the foregoing description. All changes thereto which come within the meaning and range of the equivalent of the claims are to be embraced within the scope of the claims.

What is claimed is:

1. A method of fabricating a phosphor screen, comprising:

disposing a first conductive material on a substrate;

disposing a phosphor layer on the first conductive material, wherein the phosphor layer defines a continuous plurality of active pixel regions; and etching a plurality of holes through the phosphor layer in the plurality of pixel regions to expose portions of the first conductive material, wherein the phosphor layer is continuous between the pixel regions.

2. The method of claim 1, wherein the first conductive material is transparent.

3. The method of claim 1, wherein the phosphor layer is disposed by electrophoretic deposition.

4. The method of claim 1, wherein the first conductive material is selected from the group consisting of tin oxide, indium tin oxide, and zinc oxide.

5. The method of claim 1, further comprising filling the holes with a second conductive material in contact with the first conductive material.

6. The method of claim 5, wherein the second conductive material has a thickness different from a thickness of the phosphor layer.

7. The method of claim 1, further comprising forming a layer of black material on the first conductive material and around the phosphor layer.

8. The method of claim 1, wherein the first conductive material is flat and continuous on the substrate.

9. The method of claim 1, wherein each pixel region is defined by either three, four, or six holes.

10. The method of claim 1, wherein etching a plurality of holes through the phosphor layer comprises using a layer of photoresist disposed on the phosphor layer.

11. The method of claim 1, wherein the holes have widths less than 10 microns.

12. The method of claim 1, wherein the holes are open and not filled.

13. A method of fabricating a phosphor screen, comprising:

disposing a first conductive material on a substrate;

forming a mask on the first conductive material, thereby leaving unmasked portions of the first conductive material;

disposing phosphor on the unmasked portions of the first conductive material to define a continuous plurality of active pixel regions; and removing the mask, thereby leaving holes in the phosphor that defines the continuous plurality of active pixel regions, wherein the holes at least initially expose the first conductive material during the method, and wherein the phosphor is continuous between the pixel regions.

14. The method of claim 13, wherein the mask is a photoresist.

15. The method of claim 13, wherein the first conductive material is transparent.

16. The method of claim 13, wherein the phosphor is disposed by electrophoretic deposition.

17. The method of claim 13, wherein the first conductive material is selected from the group consisting of tin oxide, indium tin oxide, and zinc oxide.

18. The method of claim 13, further comprising filling the holes with a second conductive material in contact with the first conductive material.

19. The method of claim 18, wherein the second conductive material has a thickness different from a thickness of the phosphor.

20. The method of claim 13, further comprising forming a layer of black material on the first conductive material and around the phosphor.

21. The method of claim 13, wherein the first conductive material is flat and continuous on the substrate.

22. The method of claim 13, wherein each pixel region is defined by either three, four, or six holes.

23. The method of claim 13, further comprising baking the phosphor.

24. The method of claim 23, wherein the phosphor is baked at a temperature greater than 300° C.

25. The method of claim 24, wherein the phosphor is baked at a temperature of between 400 and 700° C.

26. The method of claim 13, wherein the holes have widths less than 10 microns.

27. The method of claim 13, wherein the holes are open and not filled.

28. A method of assembling a display screen, comprising:

disposing a cathode emitter plate in opposing parallel relationship to a phosphor anode screen to define an evacuated chamber therebetween, the screen comprising:

a substrate;

a layer of first conductive material on the substrate; and a layer of phosphor on the first conductive material defining a continuous plurality of active pixel regions, the phosphor layer defining a plurality of holes in the plurality of pixel regions to the first conductive material that define the pixel regions, and wherein the layer of phosphor is continuous between the pixel regions.

29. The method of claim 28, wherein the cathode emitter plate and the phosphor anode screen are separated by spacers.

30. The method of claim 28, wherein the first conductive material layer is light permeable.

31. The method of claim 28, wherein the first conductive material comprises at least one compound selected from the group consisting of indium tin oxide, tin oxide, and zinc oxide.

32. The method of claim 28, wherein the phosphor anode screen further comprises a black material defining a border around a periphery of the phosphor layer.

33. The method of claim 32, wherein the border defines a display region of the display screen.

34. The method of claim 28, wherein the layer of phosphor is monochrome.

35. The method of claim 28, wherein the layer of phosphor is formed by electrophoretic deposition.

36. The method of claim 35, wherein the holes are filled with a second conductive material in contact with the first conductive material.

37. The method of claim 36, wherein the second conductive material has a thickness different from a thickness of the phosphor layer.

38. The method of claim 28, wherein the first conductive material is flat and continuous on the substrate.

39. The method of claim 28, wherein the holes expose portions of the first conductive material to the evacuated chamber.

40. The method of claim 28, wherein each pixel region is defined by either three, four, or six holes.

41. The method of claim 28, wherein the holes have widths less than 10 microns.

42. A method of fabricating a phosphor screen, comprising:

disposing a first conductive material on a substrate;

disposing a phosphor layer on the first conductive material, wherein the phosphor layer defines a continuous plurality of active pixel regions, and wherein the phosphor layer is disposed by electrophoretic deposition; and etching a plurality of holes through the phosphor layer in the plurality of pixel regions to expose portions of the first conductive material.

43. The method of claim 42, wherein the phosphor layer is continuous between the pixel regions.

44. The method of claim 42, wherein the first conductive material is transparent.

45. The method of claim 42, wherein the first conductive material is selected from the group consisting of tin oxide, indium tin oxide, and zinc oxide.

46. The method of claim 42, further comprising filling the holes with a second conductive material in contact with the first conductive material.

47. The method of claim 46, wherein the second conductive material has a thickness different from a thickness of the phosphor layer.

48. The method of claim 42, further comprising forming a layer of black material on the first conductive material and around the phosphor layer.

49. The method of claim 42, wherein the first conductive material is flat and continuous on the substrate.

50. The method of claim 43, wherein each pixel region is defined by either three, four, or six holes.

51. The method of claim 42, wherein etching a plurality of holes through the phosphor layer comprises using a layer of photoresist disposed on the phosphor layer.

52. The method of claim 42, wherein the holes have widths less than 10 microns.

53. The method of claim 42, wherein the holes are open and not filled.

54. A method of fabricating a phosphor screen, comprising:

disposing a first conductive material on a substrate;

disposing a phosphor layer on the first conductive material, wherein the phosphor layer defines a plurality of pixel regions; and etching a plurality of holes through the phosphor layer to expose portions of the first conductive material, wherein the holes are open and not filled.

55. The method of claim 54, wherein the phosphor layer is continuous between the pixel regions.

56. The method of claim 54, wherein the first conductive material is transparent.

57. The method of claim 54, wherein the phosphor layer is disposed by electrophoretic deposition.

58. The method of claim 54, wherein the first conductive material is selected from the group consisting of tin oxide, indium tin oxide, and zinc oxide.

59. The method of claim 54, further comprising filling the holes with a second conductive material in contact with the first conductive material.

60. The method of claim 59, wherein the second conductive material has a thickness different from a thickness of the phosphor layer.

61. The method of claim 54, further comprising forming a layer of black material on the first conductive material and around the phosphor layer.

62. The method of claim 54, wherein the first conductive material is flat and continuous on the substrate.

63. The method of claim 55, wherein each pixel region is defined by either three, four, or six holes.

64. The method of claim 54, wherein etching a plurality of holes through the phosphor layer comprises using a layer of photoresist disposed on the phosphor layer.

65. The method of claim 54, wherein the holes have widths less than 10 microns.

66. A method of fabricating a phosphor screen, comprising:

disposing a first conductive material on a substrate;

forming a mask on the first conductive material, thereby leaving unmasked portions of the first conductive material;

disposing phosphor on the unmasked portions of the first conductive material to form pixel regions; and removing the mask, thereby leaving holes in the phosphor, and wherein the holes are open and not filled.

67. The method of claim 66, wherein the mask is a photoresist.

68. The method of claim 66, wherein the phosphor is continuous between the pixel regions.

69. The method of claim 66, wherein the first conductive material is transparent.

70. The method of claim 66, wherein the phosphor is disposed by electrophoretic deposition.

71. The method of claim 66, wherein the first conductive material is selected from the group consisting of tin oxide, indium tin oxide, and zinc oxide.

72. The method of claim 66, further comprising forming a layer of black material on the first conductive material and around the phosphor.

73. The method of claim 66, wherein the first conductive material is flat and continuous on the substrate.

74. The method of claim 68, wherein each pixel region is defined by either three, four, or six holes.

75. The method of claim 66, further comprising baking the phosphor.

76. The method of claim 75, wherein the phosphor is baked at a temperature greater than 300° C.

77. The method of claim 76, wherein the phosphor is baked at a temperature of between 400 and 700° C.

78. The method of claim 66, wherein the holes have widths less than 10 microns.

79. A method of assembling a display screen, comprising:

disposing a cathode emitter plate in opposing parallel relationship to a phosphor anode screen to define an evacuated chamber therebetween, the screen comprising:

a substrate;

a layer of first conductive material on the substrate; and a layer of phosphor on the first conductive material defining a plurality of pixel regions, the phosphor layer defining a plurality of holes to the first conductive material that define the pixel regions, wherein wherein the holes are open and not filled.

80. The method of claim 79, wherein the layer of phosphor is continuous between the pixel regions.

81. The method of claim 79, wherein the cathode emitter plate and the phosphor anode screen are separated by spacers.

82. The method of claim 79, wherein the first conductive material layer is light permeable.

83. The method of claim 79, wherein the first conductive material comprises at least one compound selected from the group consisting of indium tin oxide, tin oxide, and zinc oxide.

84. The method of claim 79, wherein the phosphor anode screen further comprises a black material defining a border around a periphery of the phosphor layer.

85. The method of claim 84, wherein the border defines a display region of the display screen.

86. The method of claim 79, wherein the layer of phosphor is monochrome.

87. The method of claim 79, wherein the layer of phosphor is formed by electrophoretic deposition.

88. The method of claim 79, wherein the first conductive material is flat and continuous on the substrate.

89. The method of claim 79, wherein the holes expose portions of the first conductive material to the evacuated chamber.

90. The method of claim 79, wherein each pixel region is defined by either three, four, or six holes.

91. The method of claim 79, wherein the holes have widths less than 10 microns.

92. A method of assembling a display screen, comprising:

disposing a cathode emitter plate in opposing parallel relationship to a phosphor anode screen to define an evacuated chamber therebetween, the screen comprising:

a substrate;

a layer of first conductive material on the substrate; and a layer of phosphor on the first conductive material defining a plurality of pixel regions, the phosphor layer having etched therethrough a plurality of holes to the first conductive material that define the pixel regions, and wherein the phosphor layer is disposed by electrophoretic deposition.

93. The method of claim 92, wherein the layer of phosphor is continuous between the pixel regions.

94. The method of claim 92, wherein the cathode emitter plate and the phosphor anode screen are separated by spacers.

95. The method of claim 92, wherein the first conductive material layer is light permeable.

96. The method of claim 92, wherein the first conductive material comprises at least one compound selected from the group consisting of indium tin oxide, tin oxide, and zinc oxide.

97. The method of claim 92, wherein the phosphor anode screen further comprises a black material defining a border around a periphery of the phosphor layer.

98. The method of claim 97, wherein the border defines a display region of the display screen.

99. The method of claim 92, wherein the layer of phosphor is monochrome.

100. The method of claim 92, wherein the layer of phosphor is formed by electrophoretic deposition.

101. The method of claim 100, wherein the holes are filled with a second conductive material in contact with the first conductive material.

102. The method of claim 101, wherein the second conductive material has a thickness different from a thickness of the phosphor layer.

103. The method of claim 92, wherein the first conductive material is flat and continuous on the substrate.

104. The method of claim 92, wherein the holes expose portions of the first conductive material to the evacuated chamber.

105. The method of claim 92, wherein each pixel region is defined by either three, four, or six holes.

106. The method of claim 92, wherein the holes have widths less than 10 microns.

* * * * *